US008079559B1

(12) United States Patent
Say

(10) Patent No.: US 8,079,559 B1
(45) Date of Patent: Dec. 20, 2011

(54) ASPIRATOR BRACKET

(75) Inventor: Samuel D. Say, Los Alamitos, CA (US)

(73) Assignee: SSCOR, Inc., Sun Valley, CA (US)

( * ) Notice: Subject to any disclaimer, the term of this patent is extended or adjusted under 35 U.S.C. 154(b) by 511 days.

(21) Appl. No.: 11/524,662

(22) Filed: Sep. 20, 2006

Related U.S. Application Data

(63) Continuation of application No. 10/376,521, filed on Feb. 28, 2003, now abandoned.

(60) Provisional application No. 60/360,397, filed on Feb. 28, 2002.

(51) Int. Cl.

| | |
|---|---|
| ***A47B 96/00*** | (2006.01) |
| ***A47K 1/00*** | (2006.01) |
| ***A47K 5/00*** | (2006.01) |
| ***E04G 5/06*** | (2006.01) |
| ***F16L 3/08*** | (2006.01) |
| ***F21V 35/00*** | (2006.01) |

(52) U.S. Cl. ..... 248/222.12; 248/221.11; 248/222.11; 604/322

(58) Field of Classification Search ..... 604/322; 248/221.11, 222.12, 221.12; 422/44–47
See application file for complete search history.

(56) References Cited

U.S. PATENT DOCUMENTS

| | | | | |
|---|---|---|---|---|
| 5,449,347 | A | | 9/1995 | Preen et al. |
| 5,478,037 | A | * | 12/1995 | Haltof ..... 248/221.11 |
| 5,566,676 | A | | 10/1996 | Rosenfeldt et al. |
| 5,662,627 | A | * | 9/1997 | Say ..... 604/319 |
| 5,829,723 | A | | 11/1998 | Brunner et al. |
| 5,954,704 | A | | 9/1999 | Sherman |
| 6,593,528 | B2 | | 7/2003 | Franklin-Lees et al. |

* cited by examiner

*Primary Examiner* — Melanie Hand
(74) *Attorney, Agent, or Firm* — Christie, Parker & Hale, LLP

(57) ABSTRACT

A bracket for mounting a portable aspirator to a wall. The bracket allows easy securing and removing of the aspirator with one hand in emergency situations. The bracket will also secure the aspirator against a 10 G loading force. Electrical leads on both the aspirator and the bracket allow the aspirator to charge when secured.

20 Claims, 11 Drawing Sheets

ASPIRATOR BRACKET

CROSS-REFERENCE TO RELATED APPLICATION(S)

This application is a continuation of application Ser. No. 10/376,521, filed Feb. 28, 2003, now abandoned, which claimed priority to U.S. Provisional Application No. 60/360,397, filed Feb. 28, 2002, the disclosures of which are incorporated fully herein by reference.

FIELD OF THE INVENTION

The present invention relates to a bracket for securing a portable aspirator to a wall.

BACKGROUND OF THE INVENTION

In recent years, portable aspirators have gained popularity, in part due to an increased awareness of the need for sanitary aspiration techniques for avoiding the spread of infectious disease. These aspirators are often used by fire fighters, paramedics, and other rescue and health workers.

Ambulances, especially those used in foreign countries, have very small patient compartments which must fit at least a patient, an emergency medical technician, and a multitude of medical equipment. Furthermore, in most countries, any device stored in an ambulance must be capable of withstanding a 10 G loading force without becoming unsecured. Due to the restricted space and the 10 G loading force requirement, in many situations portable aspirators are precluded from being carried in the patient compartment. There exists a need for a bracket which is capable of securing the aspirator against a 10 G loading force, on which a portable aspirator can be mounted without taking up limited floor space, and which takes up very little space in the patient compartment in general.

In emergency situations, emergency workers must handle many pieces of equipment simultaneously and they must be able to easily remove equipment from their secured positions in the ambulance. There exists a need for a bracket on which a portable aspirator may be easily secured and from which a portable aspirator may be easily removed using one hand.

Typically, after a portable aspirator has been used, the aspirator is plugged into a power source to recharge its batteries. If a portable aspirator finds many continuous uses in one day while out in rescues with an ambulance, its battery may run dead preventing its further use. A system, therefore, that allows the portable aspirator to be recharged while being securely transported within the ambulance can provide a great benefit to the health and rescue industries.

SUMMARY OF THE INVENTION

The present invention is a bracket for mounting a portable aspirator to a wall in an ambulance or the wall of a hospital crash cart. The bracket is designed to allow easy securing and removing of the aspirator with one hand. The aspirator can be secured to the wall by slipping it onto the bracket. Once secured, the portable aspirator can withstand a 10 G loading force without becoming unsecured from the bracket. Nevertheless, the aspirator can be removed with just one hand by activating a squeeze plate with a thumb and lifting the aspirator off of the bracket by an attached handle. The bracket also has two electrical contacts which connect to two matching electrical contacts on the aspirator when it is secured to the wall, charging the aspirator by drawing current from the vehicle, crash cart, or the wall.

DETAILED DESCRIPTION OF THE INVENTION

Figure 1:
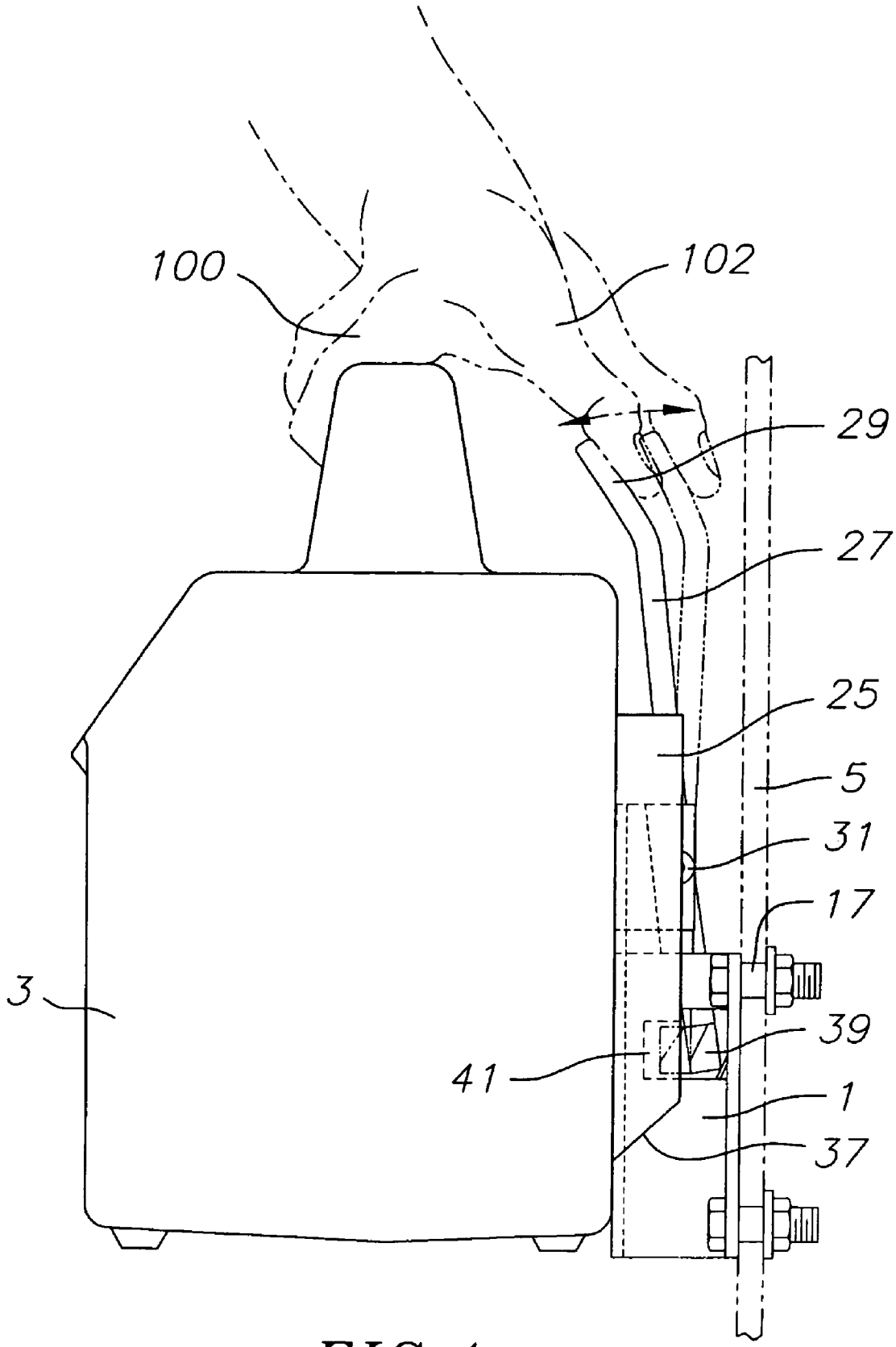
FIG. 1 is a side view of the portable aspirator secured to the bracket on the wall.

The invention is a bracket 1 (FIGS. 3 & 6) for attaching an aspirator 3 to a wall 5. Aspirator 3 may be of the type described in U.S. Pat. No. 5,662,627 or any other commonly known type of aspirator 3. Wall 5 may be the inside wall of an ambulance, the outside wall of a hospital crash cart, or any other wall to which aspirator 3 may be attached. Bracket 1 holds aspirator 3 firmly and allows for quick and easy release of aspirator 3 using only one hand, as shown in FIG. 1.

Figure 2:
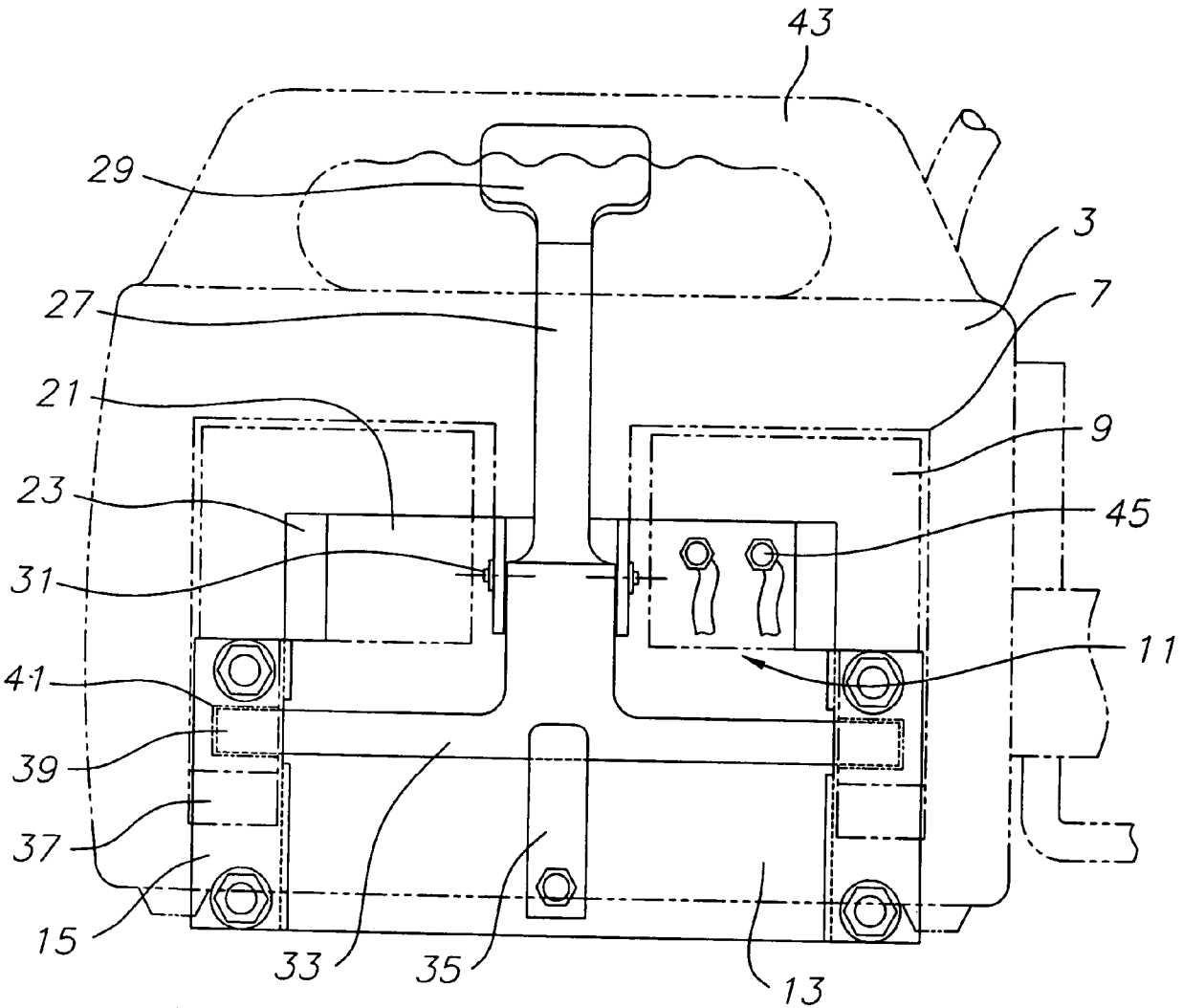
FIG. 2 is a back view of the portable aspirator secured to the bracket.
Figure 3:
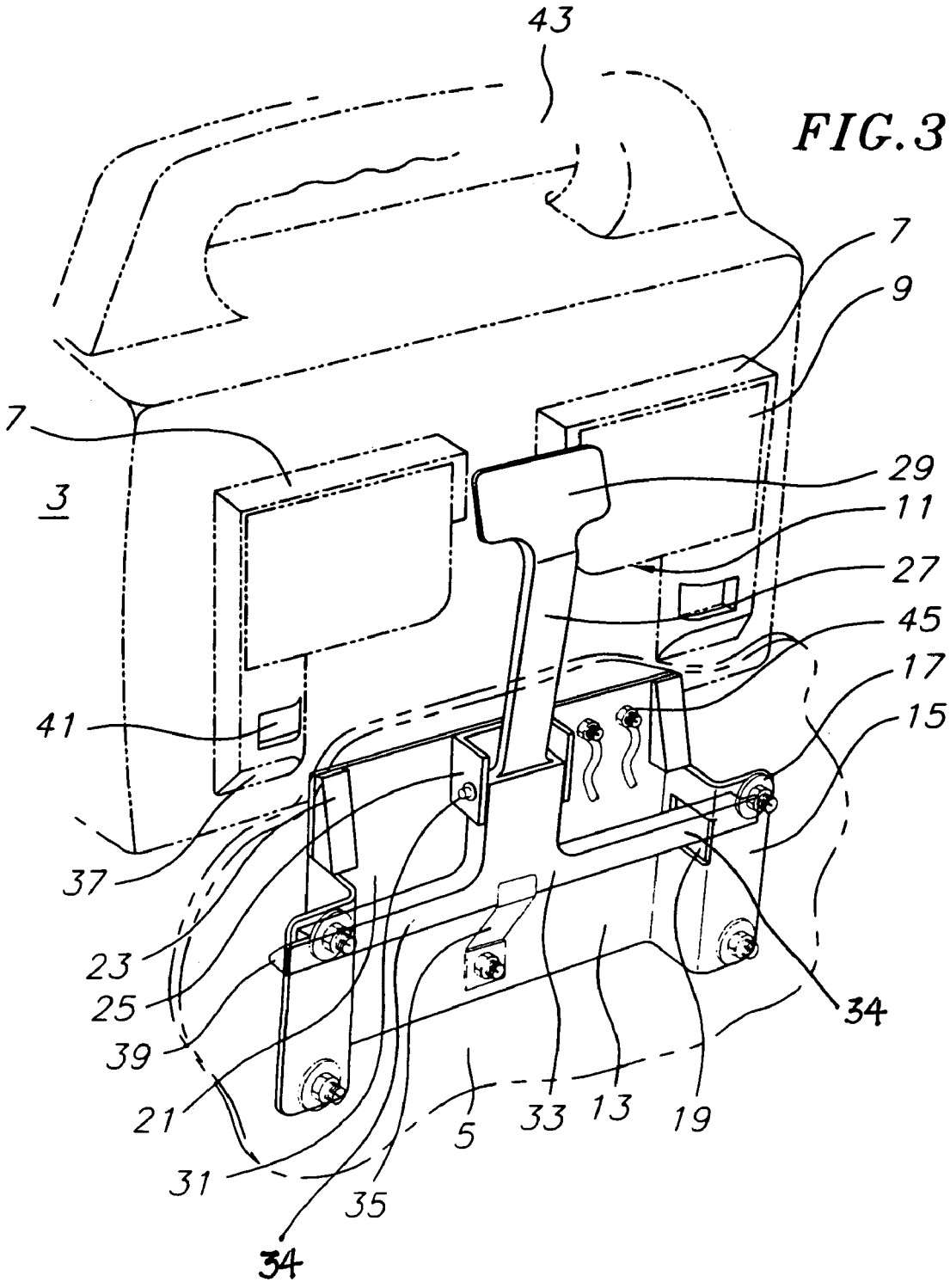
FIG. 3 is an isometric view of the portable aspirator separated from the bracket.

As shown in FIGS. 2 & 3, the back of aspirator 3 has two "L" shaped risers 7 which serve as upwardly opening pockets and form a space for bracket 1 to attach to aspirator 3. Risers 7 are positioned symmetrically in the two upper quadrants of the back of aspirator 3, with the vertical sides in the L's parallel to the sides of aspirator 3 and with the vertical sides farther from rather than closer to each other. Risers 7 may be formed in the back of aspirator 3 from the material of the casing of aspirator 3, e.g. plastic. Alternatively, risers 7 may be formed separately and later attached to the back of aspirator 3.

Mounted on top of each riser 7, parallel to wall 5, is a guide plate 9, as shown in FIG. 3. Guide plates 9 interact with risers 7 to form two pockets 11 for receiving bracket 1. Pockets 11 engage aspirator 3 more securely than possible with only one pocket. The opening of pockets 11 face down and toward each other, so they form a sheath for bracket 1. Guide plates 9 may be attached to risers 7 with screws and guide plates 9 may be made of any strong and light material such as any number of alloys.

Figure 5A:
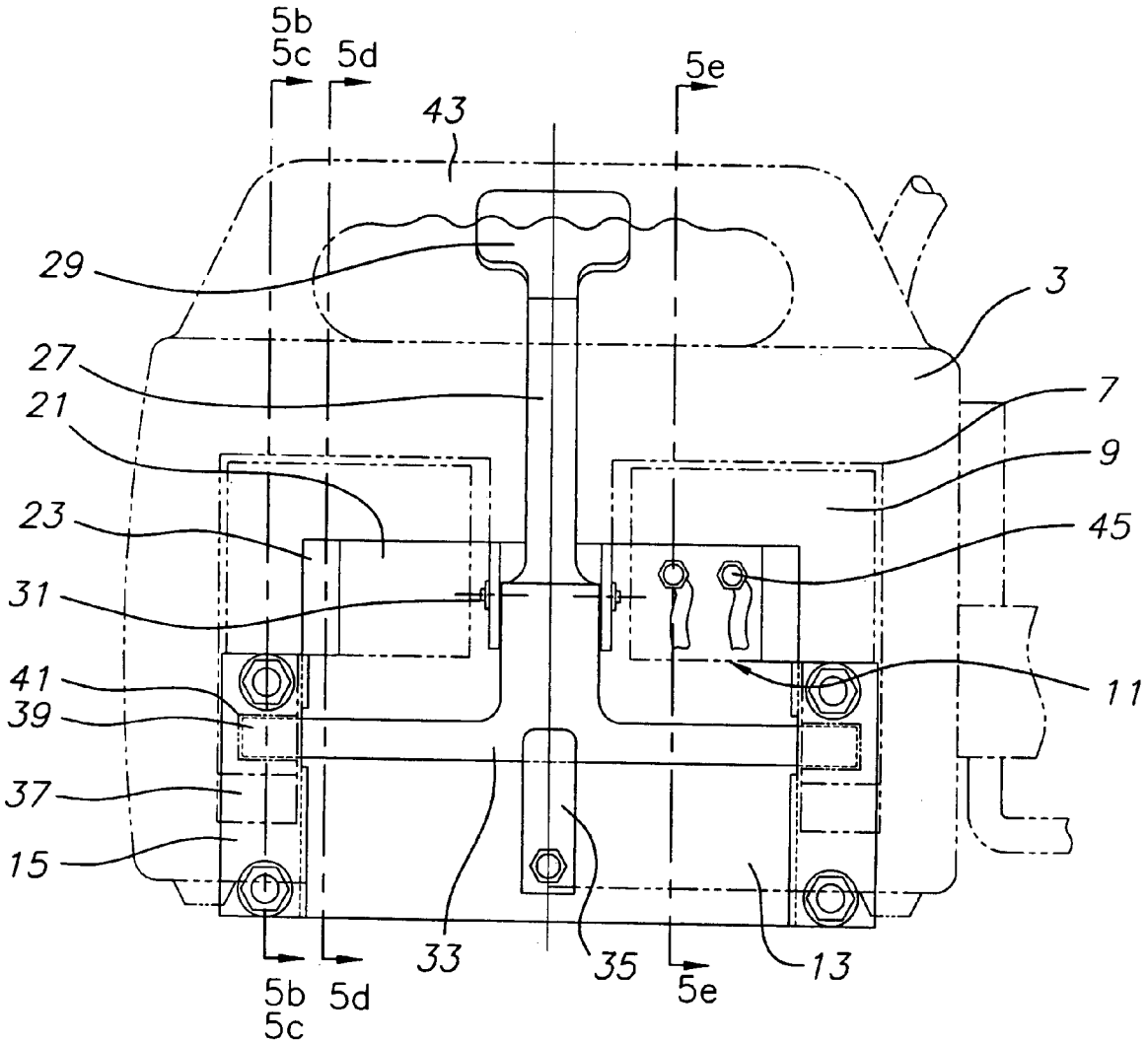
FIG. 5*a* is a back view of the portable aspirator secured to the bracket, with guidelines showing the position of various cross sectional views.
Figure 5B:
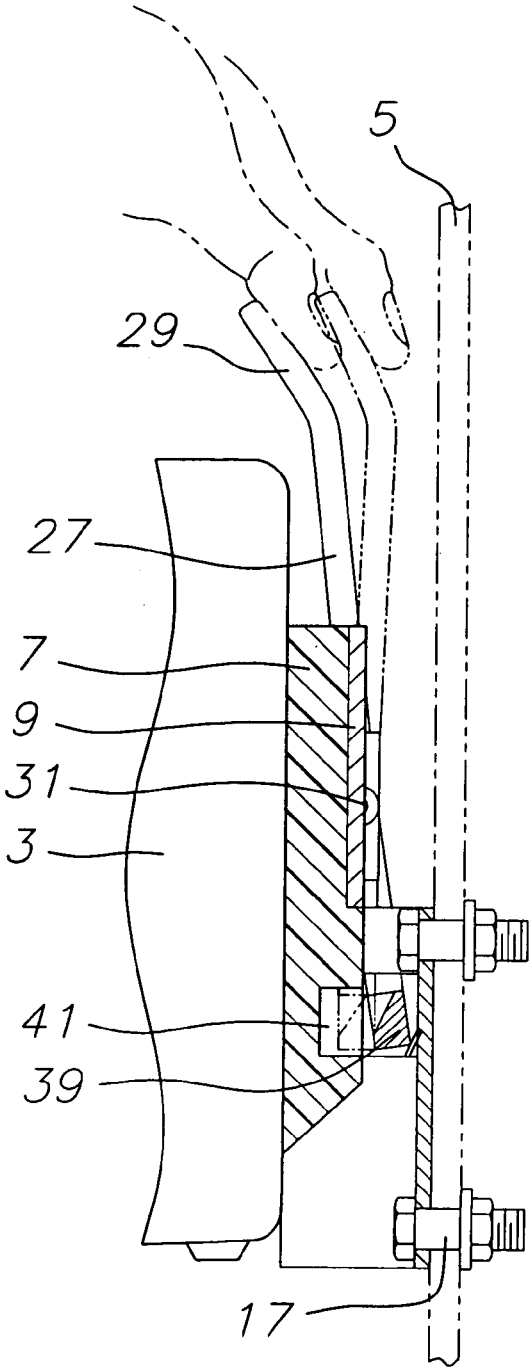
FIG. 5*b* is a cross sectional view through the notch in the portable aspirator and the latch in the bracket, showing the latch in its released position.
Figure 5C:
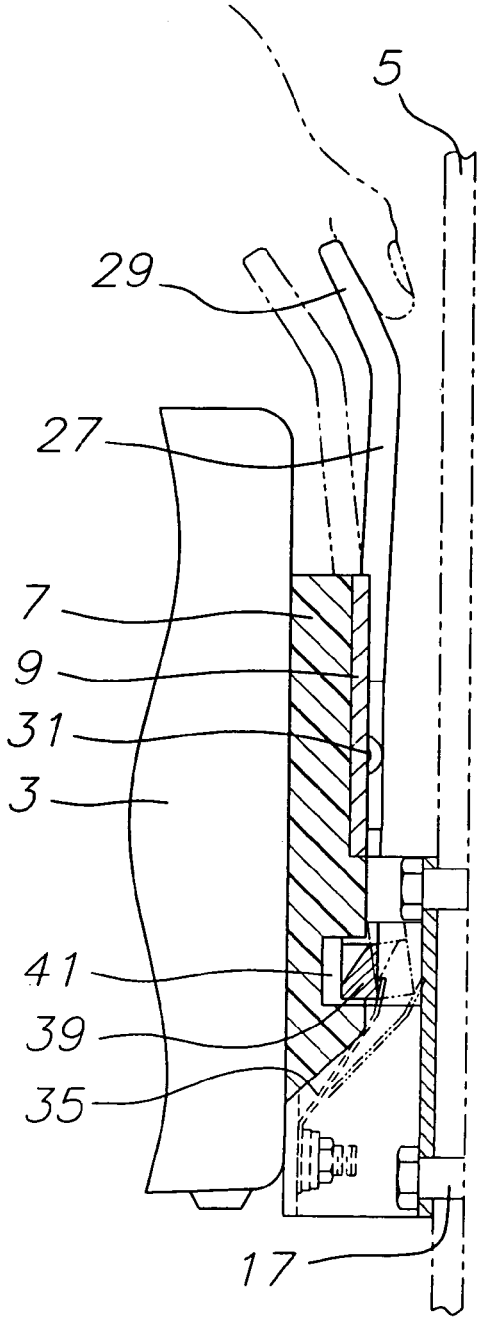
FIG. 5*c* is a cross sectional view through the notch in the portable aspirator and the latch on the bracket, showing the latch in its locked position.
Figure 5D:
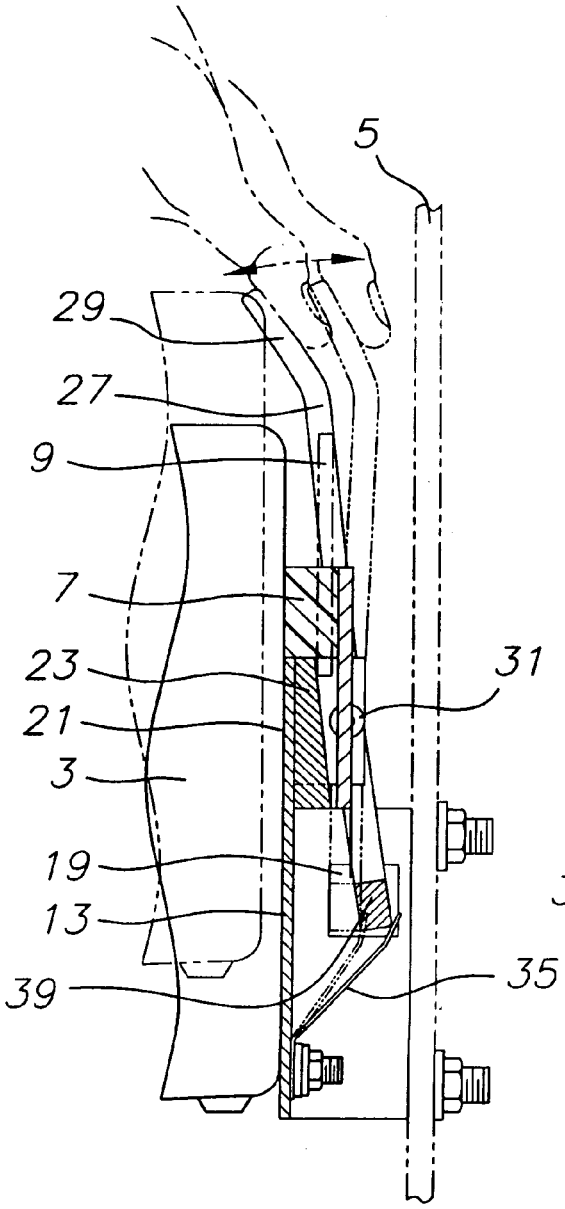
FIG. 5*d* is a cross sectional view through the guide plate on the portable aspirator and the ramp on the bracket.
Figure 5E:
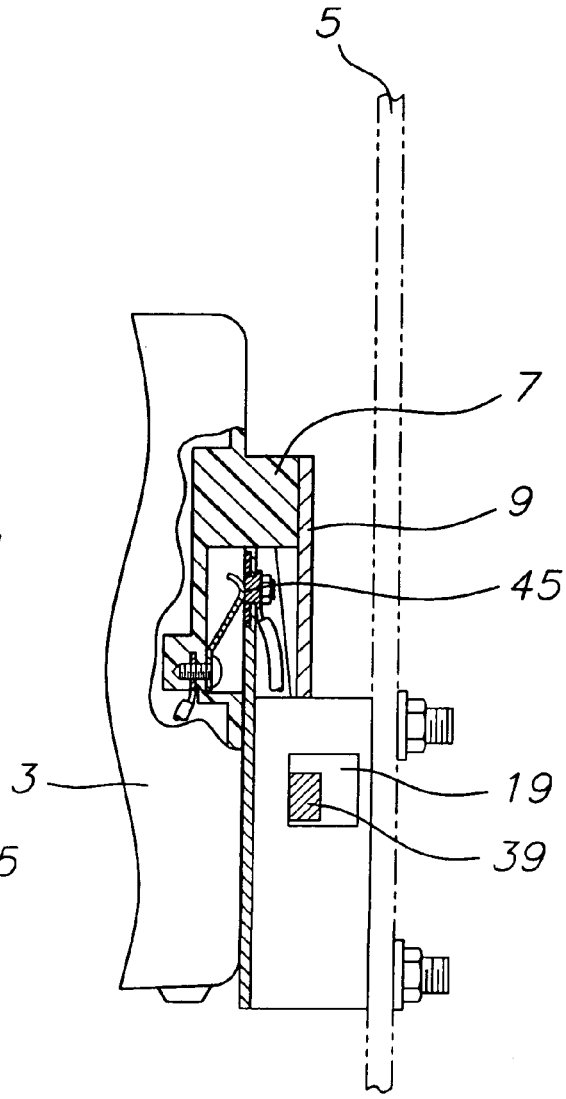
FIG. 5*e* is a cross sectional view through the electrical contacts on both the portable aspirator and the bracket.
Figure 6:
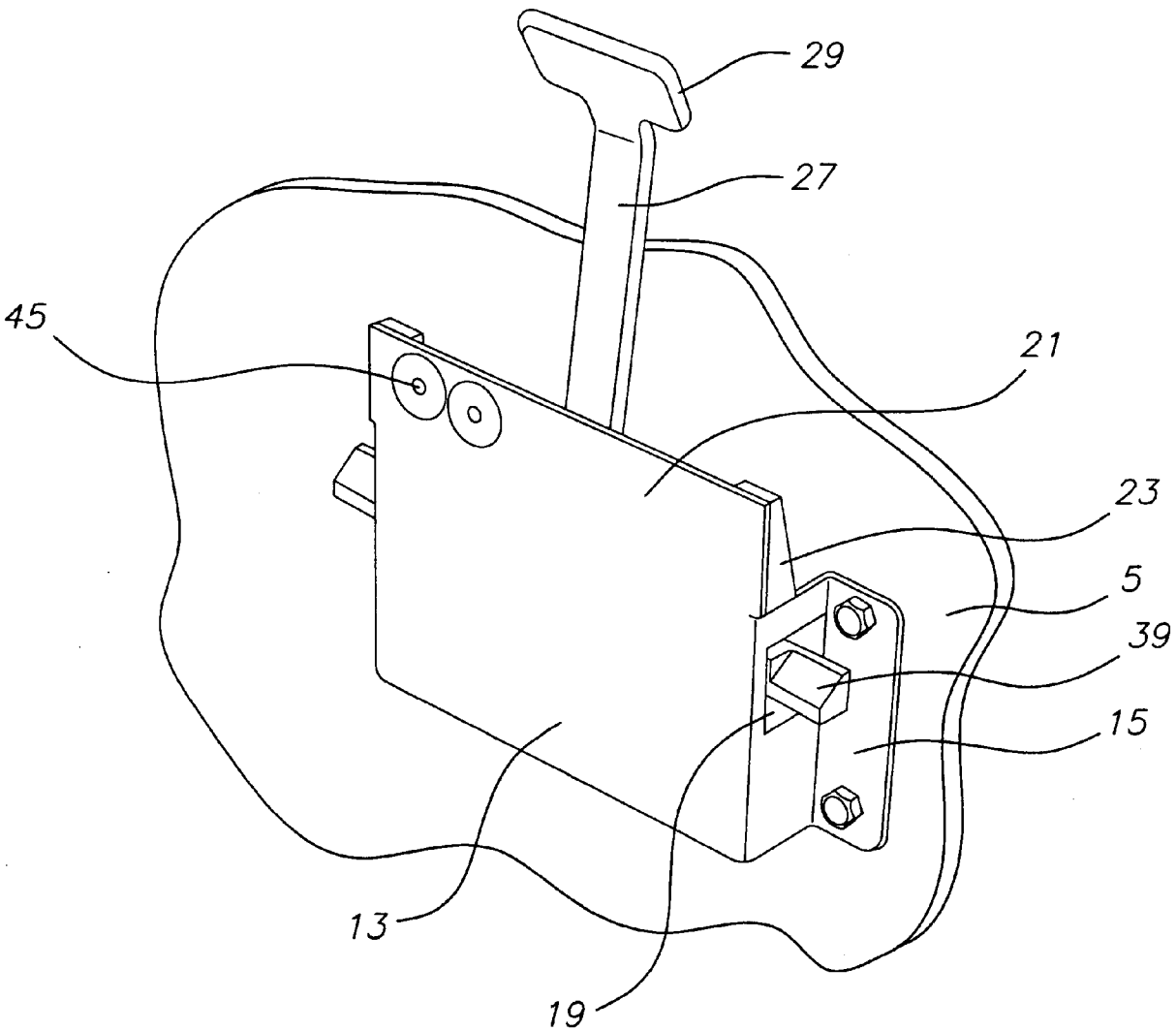
FIG. 6 is an isometric view of the bracket.

Bracket 1 may be formed from a generally rectangular piece of strong and light material such as any number of alloys. The shorter ends of bracket 1 are each twice bent at ninety degrees, as shown in FIG. 6, to create an outwardly facing flange 15 parallel to a main body 13 of bracket 1. Two small round holes 17 are formed in each flange 15 for mounting to wall 5, as shown in FIGS. 5*b* & 5*c*. FIGS. 5*b*-5*e* are cross sectional views through various parts of bracket 1 and aspirator 3 as shown in FIG. 5*a*. A small rectangular opening 19 is formed in each of the two sections of the bracket 1 which are perpendicular to main body 13 and flange 15, as shown in FIGS. 5*d* & 5*e*. These openings 19 are aligned with each other and the long edge of opening 19 starts at the right angle connecting to flange 15 and extends toward, but not quite reaches, the right angle connecting to main body 13.

One of the sides of bracket 1 which does not form any part of flange 15 extends away from the rectangle to form a protruding section 21, as shown in FIGS. 3 & 6. Protruding section 21 connects to the rest of bracket 1 only at its bottom edge. On the side of protruding section 21 facing away from aspirator 3 are two ramps 23, as shown in FIGS. 3 & 5*d*. These ramps 23 are wedge shaped and made of a low friction material. Ramps 23 are mounted on the outside corners of protruding section 21 in a vertical position with the small end of the wedge pointed up and the slanted side facing away from aspirator 3.

Referring to FIGS. 3 & 5*d*, as pockets 11 on aspirator 3 begin to engage protruding section 21 of bracket 1, the bottoms of guide plates 9 engage the tops of ramps 23. As aspirator 3 is lowered onto the top of protruding section 21, the slant of ramps 23 translates some of the downward vertical force exerted by guide plates 9 to a horizontal direction and pulls aspirator 3 toward bracket 1, eventually closing the space between main body 13 of bracket 1 and aspirator 3 and wall 5. When aspirator 3 initially engages bracket 1, the space between guide plate 9 and ramp 23 is larger than when aspirator 1 is fully mounted on bracket 3. This larger space makes it easier to engage bracket 1 and aspirator 3.

When aspirator 1 is in its final position fully mounted on bracket 3, aspirator 1 is supported in the vertical direction by the bottom of the horizontal surface of risers 7 final on the tops of protruding section 21 and wedged against ramps 23, so aspirator 1 does not move. Aspirator 1 is further supported by the bottom of the horizontal surface of guide plate 9 resting on the tops of the two sections of bracket 1 which are perpendicular to main body 13 and flange 15.

As shown in FIG. 3, at the far end of protruding section 21 of bracket 1, along the vertical midline, a "U" shaped yoke 25 is connected to the side of bracket 1 facing away from aspirator 3. Yoke 25 may be made of the same material of bracket 1 and it may be welded onto bracket 1. One small round hole is formed in each side of the "U" forming yoke 25. The holes are aligned with each other, allowing the mounting of a lever 27 in the "U" on a pivot rod 31 inserted through the holes. Yoke 25 is positioned so that lever 27 is mounted in the vertical midline of bracket 1.

Figure 4:
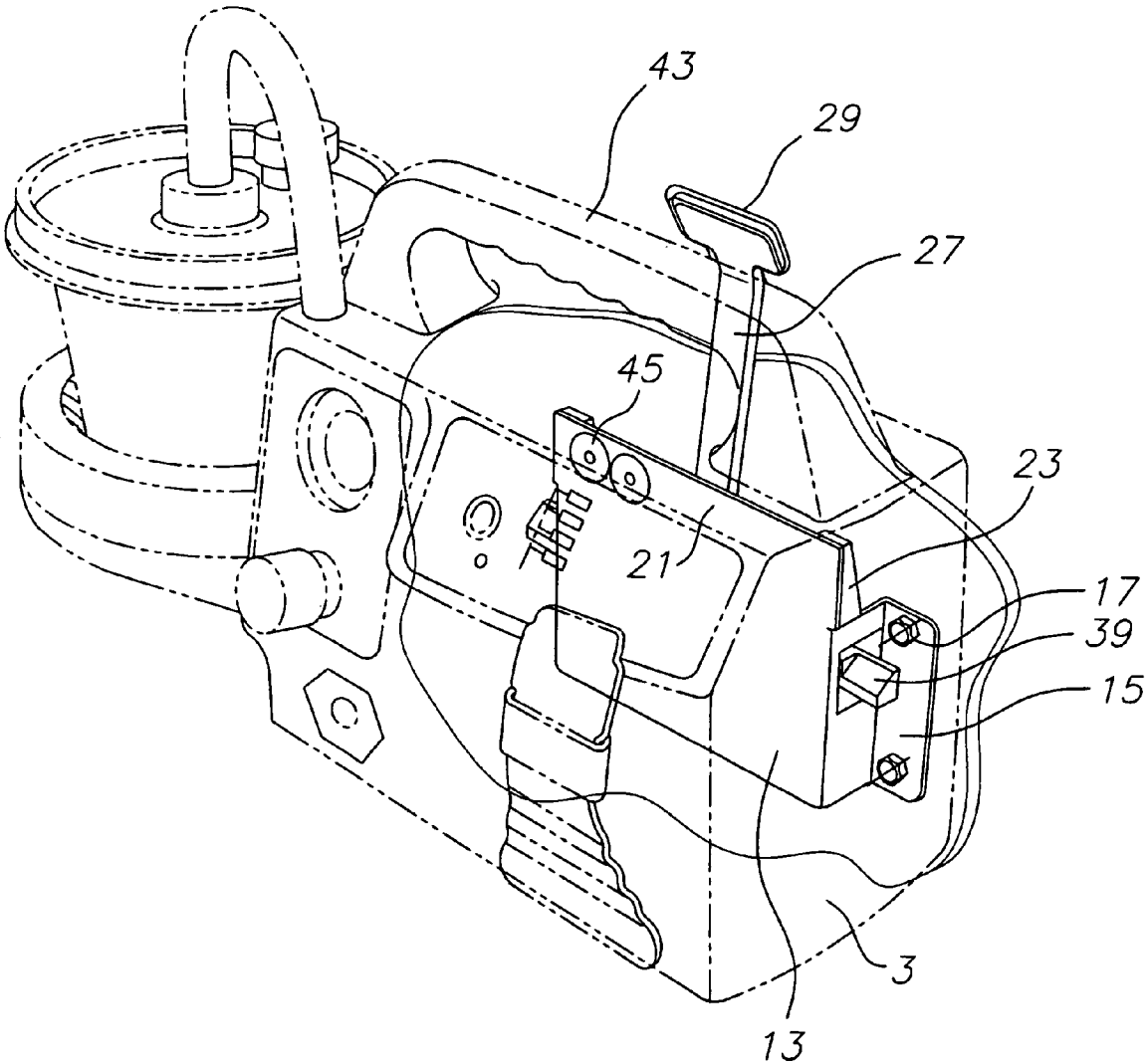
FIG. 4 is an isometric view of the portable aspirator secured to the bracket on the wall.

Above pivot rod 31, lever 27 expands to form a squeeze plate 29. Below pivot rod 31, lever 27 connects with a perpendicularly disposed latch 33, having a transverse arm 34 and forming a "T" shape. As illustrated by FIGS. 5*b*, 5*c* and 5*d*, latch 33 is moveable between a position in which aspirator 3 is held by bracket 1 and a position in which aspirator 3 is not held by bracket 1. As shown in FIGS. 3 & 4, the two ends of latch 33 form two vertically positioned locking wedges 39 with the small end of locking wedges 39 pointed upwards and the slanted side of locking wedges 39 facing aspirator 3.

Below latch 33, mounted on the vertical midline of the side of main body 13 of bracket 1 facing away from aspirator 3, is a bias arm 35. This is shown in FIGS. 3 & 5*d*. Bias arm 35 is made from a small rectangular piece of resilient material, such as any number of alloys. The longitudinal ends of the rectangle are bent away from each other, so that when one end of bias arm 35 is mounted to main body 13, the other end forms a lip which overlaps latch 33. The bends in bias arm 35 are such that bias arm 35 exerts force on latch 33 tending to urge latch 33 toward aspirator 3. Lever 27 and latch 33 may be made of any strong and light material such as any number of alloys. Furthermore, lever 27, squeeze plate 29, and latch 33 may be made as one piece, forming a "T" shape.

At the free ends of the vertical sides of risers 7, each riser 7 forms an actuating wedge 37, as shown in FIGS. 1 & 3. Each actuating wedge 37 slopes upwardly from the back of aspirator 3. Referring to FIG. 5*d*, as the interaction of guide plates 9 and ramps 23 pull aspirator 3 toward its final position on bracket 1, actuating wedges 37 push on locking wedges 39 on latch 33 and push latch 33 away from aspirator 3 and toward wall 5, thereby increasing the tension in bias arm 35.

As shown in FIGS. 1 & 3, on each riser 7, between guide plate 9 and actuating wedge 37, there is a rectangular notch 41 formed in the riser 7. Latch keepers in the form of notches 41 are aligned with each other and the long edge of notch 41 starts at the inside edge of the vertical side of riser 7 and extends toward, but not quite reaches, the outside edge. As aspirator 3 reaches its final position on bracket 1, latch 33 reaches notches 41 in riser 7. The tension in bias arm 35 moves locking wedges 39 of latch 33 into notches 41 and secures it there until the bracket is unlatched.

With locking wedges 39 of latch 33 in notches 41 on riser 7, as in FIG. 5*c*, aspirator 3 is in its locked position. When someone tries to remove aspirator 3 by pulling it up, the bottom part of locking wedge 39 abuts the bottom part of notch 41 and prevents vertical translation. When someone tries to remove aspirator 3 by pulling it away from wall 5, the side of guide plates 9 facing aspirator 3 abuts ramps 23 and prevents horizontal translation. Therefore, with locking wedges 39 of latch 33 in notches 41 on riser 7, aspirator 3 is securely attached to wall 5.

In order to lock aspirator 3 into bracket 1, a user would stand in front of bracket 1 mounted on wall 5 holding aspirator 3 by a handle 43. The user would then position aspirator 3 with its backside facing wall 5 and juxtapose pockets 11 formed by risers 7 and guide plates 9 with protruding section 21 on bracket 1. After lifting aspirator 3 so that pockets 11 are above protruding section 21 and ramps 23, the user would lower aspirator 3 onto bracket 1 so that guide plates 9 engage ramps 23.

As aspirator 3 is lowered toward its final position on bracket 1, actuating wedges 37 on risers 7 push against locking wedges 39 on latch 33, pushing latch 33 away from aspirator 3 and increasing tension in bias arm 35. As aspirator 3 reaches its final position on bracket 1, locking wedges 39 reach notches 41 on risers 7 and bias arm 35 pushes latch 33 and locking wedges 39 into notches 41, locking aspirator 3 into its final position. Note that aspirator 3 can be mounted on bracket 3 with one hand.

In order to remove aspirator 3 from its locked final position from wall 5, the user would pull squeeze plate 29 of lever 27 toward aspirator 3, as shown in FIGS. 5*b* & 5*c*, and lift aspirator 3. This pulling motion is translated via pivot rod 31 to the other end of lever 27 to move locking wedge 39 away from aspirator 3. As locking wedge 39 moves away from aspirator 3, it moves out of notches 41 on riser 7 and allows aspirator 3 to be lifted up and out of bracket 1.

Figure 9:
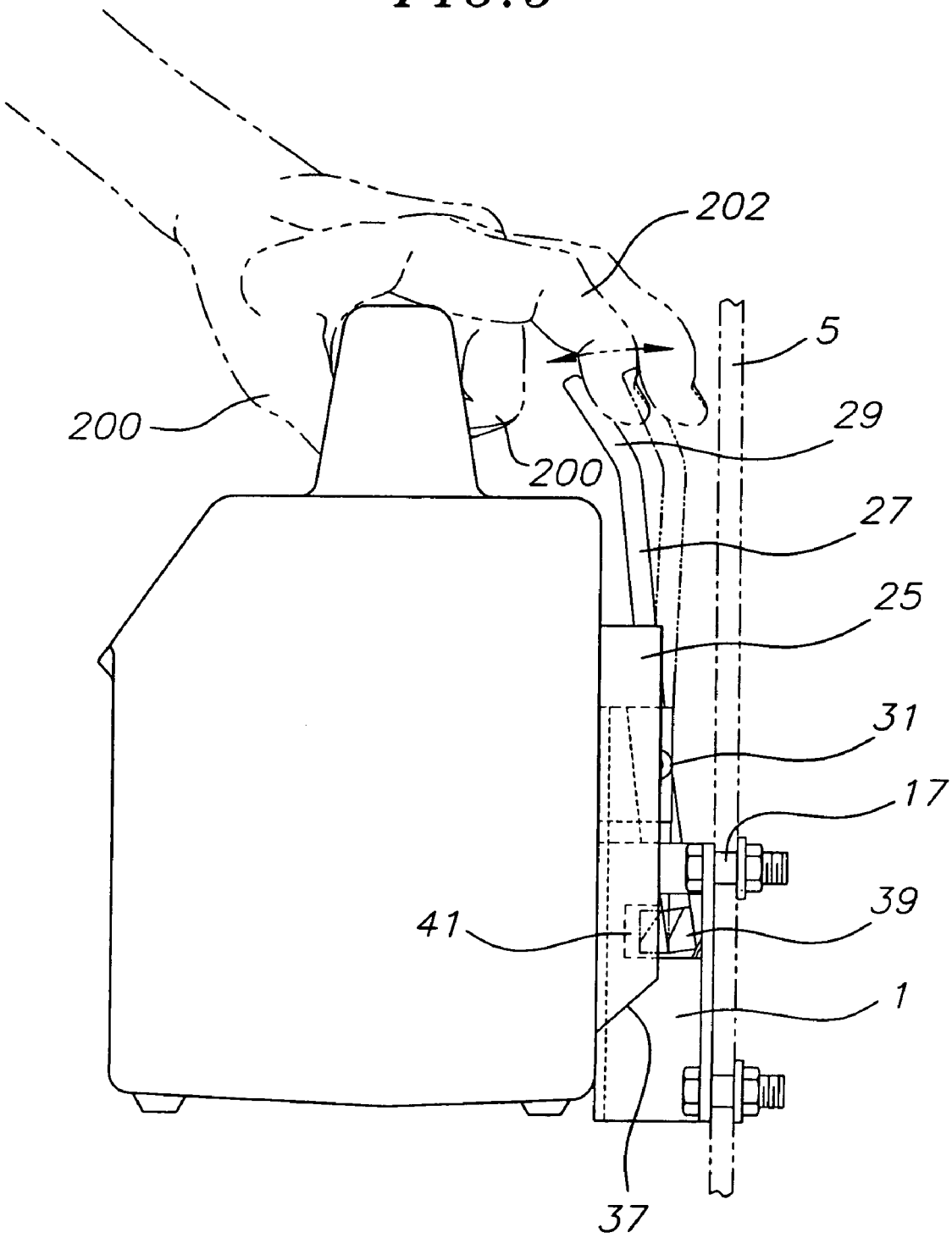
FIG. 9 is a side view of the portable aspirator secured to the bracket on the wall.

Note that aspirator 3 may be removed from bracket 1 with one hand by a user standing near wall 5. Using either hand in a palm down position, the user grasps handle 43 on top of aspirator 3 with three fingers and a thumb as shown at 200 in FIG. 9. Then the user pulls squeeze plate 29 of lever 27 toward aspirator 3 with an index finger, shown at 202, and lifts aspirator 3 up by handle 43. Once notch 41 on aspirator 3 has cleared locking wedge 39, the pressure on squeeze plate 29 may be removed. Then index finger 202, slides along squeeze plate 29, which is angled to facilitate transfer of index finger 202 to the handle 43. Locking wedges 39 will slide along actuating wedges 37 on risers 7 without impeding the vertical translation of aspirator 3.

Alternatively, aspirator 3 may be removed with one hand by a user standing approximately facing a plane normal to wall 5 with bracket 1 and mounted aspirator 3 on non-dominant side of the user's body. Using the dominant hand the user would grasp handle 43 on top of aspirator 3 with four fingers, shown at 100 in FIG. 1, pull squeeze plate 29 of lever 27 toward aspirator 3 with a thumb, shown at 102, and lift aspirator 3 up by handle 43. Once notch 41 on aspirator 3 has cleared locking wedge 39, the pressure on squeeze plate 29 may be removed. Then thumb 102, slides along squeeze plate 29, which is angled to facilitate transfer of thumb 102 to the handle 43. Locking wedges 39 will slide along actuating wedges 37 on risers 7 without impeding the vertical translation of aspirator 3.

Both aspirator 3 and bracket 1 contain reciprocal electrical contacts 45, positioned to align with each other when aspirator 3 is in the final position, as shown in FIG. 5*e*. When aspirator 3 is locked and mounted to wall 5, electrical contacts 45 on aspirator 3 make contact with electrical contacts 45 on bracket 1, allowing aspirator 3 to charge by drawing current from wall 5 on which bracket 1 is mounted. Either sets of electrical contacts 45 may be connected to fuses to prevent current overload of electrical contacts 45 or aspirator 3. The aforementioned pair of downwardly opening pockets formed by the rises 7 on the aspirator 3, and the aforementioned pair of upwardly converging wedges 39 at the ends of the transverse arm 34 of the bracket 1 drive a first pair of contacts into engagement with a second pair of contacts as the latch is being locked as shown in FIG. 5*e*.

Figure 7:
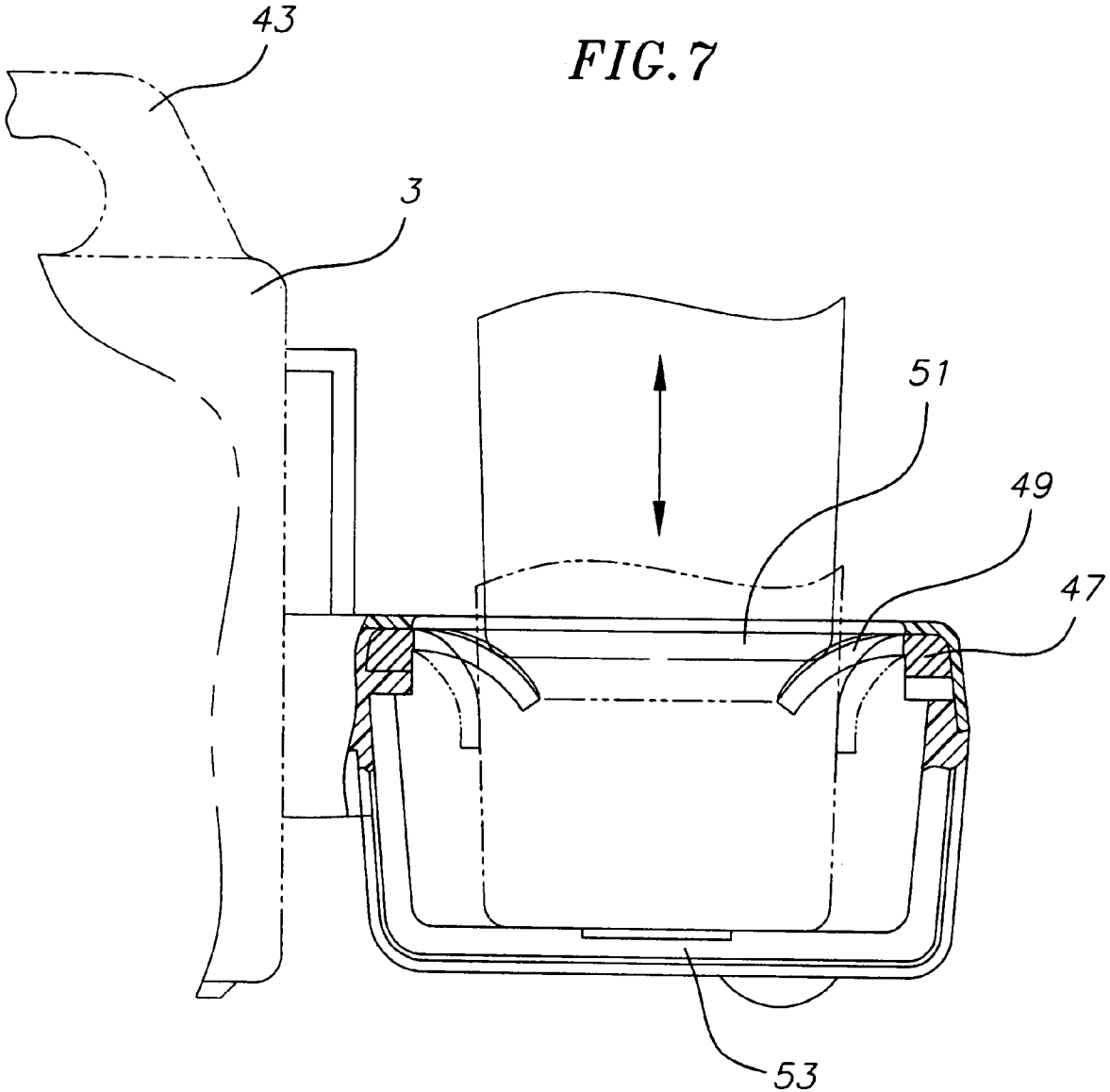
FIG. 7 is a back view of the portable aspirator and the rigid ring.
Figure 8:
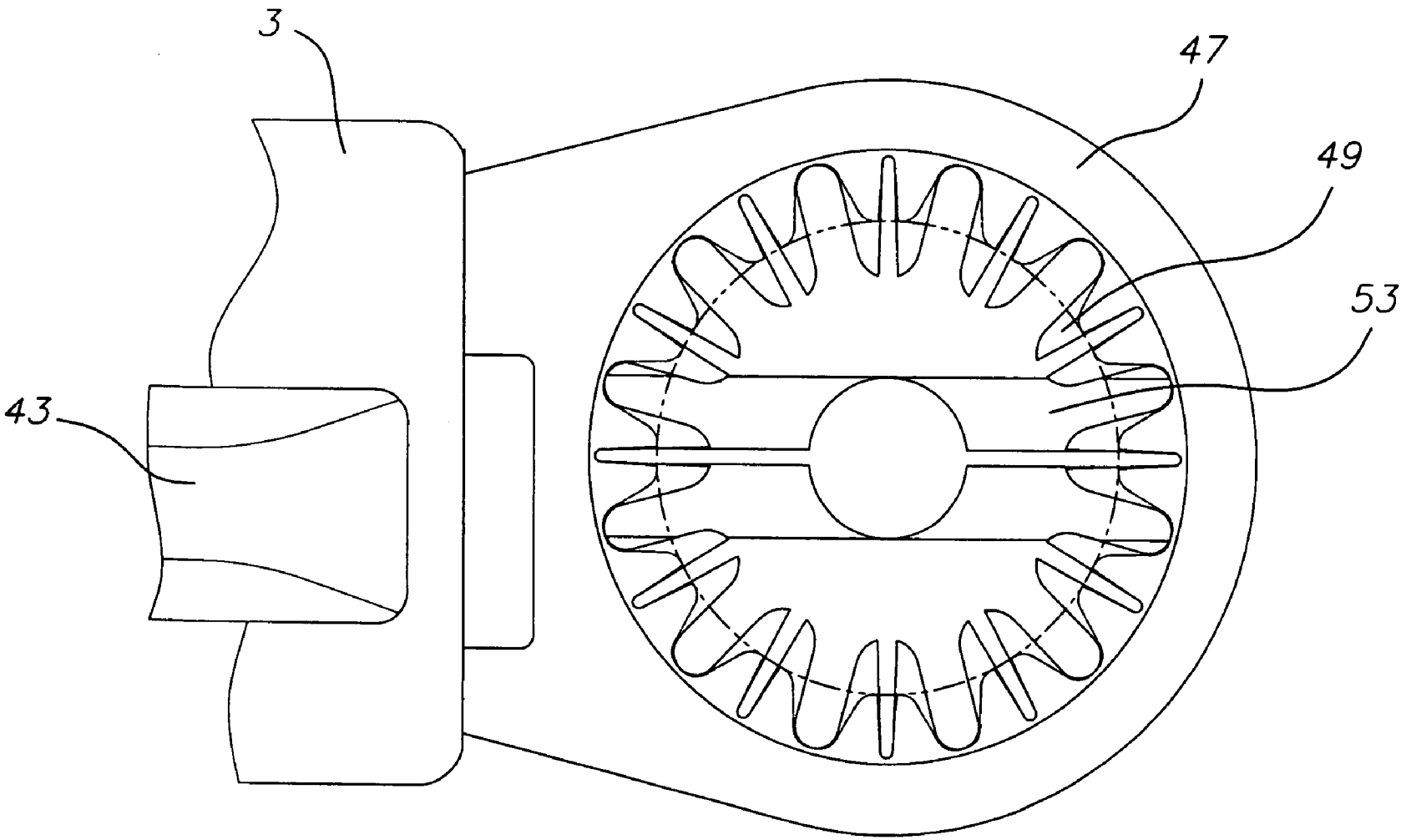
FIG. 8 is a top view of the portable aspirator and the rigid ring.

Referring to FIGS. 7*a* & 8 which are side and top views of one side of aspirator 3, a rigid ring 47 extends from the side of aspirator 3. Rigid ring 47 may be formed in the side of aspirator 3 from the material of the casing of aspirator 3, e.g. plastic. Alternatively, rigid ring 47 may be formed separately and later attached to the side of aspirator 3. Flexible fingers 49 extend along the inner circumference of rigid ring 47 radially inward. Flexible fingers 49 may be made from any flexible high friction material such as rubber.

As a canister 51, smaller than the diameter of rigid ring 47, is placed into rigid ring 47, flexible fingers 49 engage canister 51 and are forced to bend downward. Flexing of fingers 49 increases tension in fingers 49 which exert an inward force against the sides of canister 51, securing canister 51 to rigid ring 47. Downward motion of canister 51 is limited by a cross bar 53.

To secure canister 51 into rigid ring 47, a user pushes canister 51 into rigid ring 47 until canister 51 is either secured by flexible fingers 49 or resting on cross bar 53. To remove canister 51 from rigid ring 47, a user either lifts or lifts and twists canister 51 until flexible fingers 49 disengage from canister 51.

Referring to FIG. 7*b*, rigid ring 47 may be slidably and removably mounted, by means of a track, to aspirator 3. Rigid ring 47 may slide in an up and down direction. Rigid ring 47 may be temporarily secured to aspirator 3 with screws or clips. Slidably and removably mounting rigid ring 47 allows for use of a wider variety of canisters 51.

What is claimed is:

1. A bracket for securing a portable aspirator having at least one pocket, comprising:

a T-shape member comprising a latch and a lever, the latch being movable between a first position in which the aspirator is held by the bracket and a second position in which the aspirator is not held by the bracket;

at least one notch on the aspirator adapted to receive the latch for locking the portable aspirator in the bracket;

a handle on the aspirator adapted to be grasped by one of a user's hand; and at least one ramp adapted to be received in the pocket;

wherein the lever is adapted to be movable toward the aspirator by a finger or a thumb of the one user's hand while grasping the handle to allow removal of the aspirator from the bracket by the handle.

2. The bracket of claim 1, wherein the at least one ramp is configured to pull the aspirator toward the bracket.

3. The bracket of claim 2, further comprising a protruding section on which the aspirator is supported when held by the bracket.

4. The bracket of claim 1, further comprising a bias arm configured to urge the latch toward the aspirator when the aspirator is held by the bracket.

5. The bracket of claim 1, wherein the aspirator is adapted to be lifted upwardly off the bracket as the aspirator is being removed from the bracket.

6. The bracket of claim 1, further comprising a first pair of electrical contacts on the aspirator, a second pair of mating electrical contacts on the bracket, and means for driving the pairs of contacts together as the latch is being locked.

7. A bracket for securing a portable aspirator, comprising:

a T-shape member comprising a latch and a lever, the latch being movable between a first position in which the aspirator is held by the bracket and a second position in which the aspirator is not held by the bracket;

at least one notch on the aspirator adapted to receive the latch for locking the portable aspirator in the bracket;

a handle on the aspirator adapted to be grasped by one of a user's hand;

a first pair of electrical contacts on the aspirator;

a second pair of mating electrical contacts on the bracket;

a pair of upwardly opening pockets on the aspirator; and a pair of ramps on the bracket that drive the first and second pairs of contacts into engagement as the latch is being locked, wherein the lever is adapted to be movable toward the aspirator by a finger or a thumb of the one user's hand while grasping the handle to allow removal of the aspirator from the bracket by the handle.

8. The bracket of claim 1, wherein the lever includes a squeeze plate adapted for use by the user's index finger.

9. A bracket for securing a portable aspirator, comprising:

a T-shape member comprising a latch and a lever, the latch being movable between a first position in which the aspirator is held by the bracket and a second position in which the aspirator is not held by the bracket;

at least one notch on the aspirator adapted to receive the latch for locking the portable aspirator in the bracket; and a handle on the aspirator adapted to be grasped by one of a user's hand;

wherein the lever is adapted to be movable toward the aspirator by a finger or a thumb of the one user's hand while grasping the handle to allow removal of the aspirator from the bracket by the handle wherein the bracket includes at least one ramp configured to pull the aspirator toward the bracket, and wherein the at least one ramp is wedge-shaped.

10. The bracket of claim 2, wherein the at least one ramp is configured to translate a portion of a vertical force on the aspirator to a horizontal force when the aspirator begins to engage the bracket.

11. A portable aspirator and bracket assembly, comprising a portable aspirator having at least a pocket;

a bracket adapted to hold the portable aspirator, the bracket comprising:

a T-shape member comprising a latch and a lever, the latch being movable between a first position in which the aspirator is held by the bracket and a second position in which the aspirator is not held by the bracket;

a notch on the aspirator adapted to receive the latch for locking the portable aspirator in the bracket;

a handle on the aspirator adapted to be grasped by one of a user's hand; and at least one ramp adapted to be received in the pocket;

wherein the lever is adapted to be movable toward the aspirator by a finger or a thumb of the one user's hand while grasping the handle to allow removal of the aspirator from the bracket by the handle.

12. The bracket of claim 11, wherein the at least one ramp is configured to pull the aspirator toward the bracket.

13. The bracket of claim 12, further comprising a protruding section on which the aspirator is supported when held by the bracket.

14. The bracket of claim 11, further comprising a bias arm configured to urge the latch toward the aspirator when the aspirator is held by the bracket.

15. The bracket of claim 11, wherein the aspirator is adapted to be lifted upwardly off the bracket as the aspirator is being removed from the bracket.

16. The bracket of claim 11, further comprising a first pair of electrical contacts on the aspirator, a second pair of mating electrical contacts on the bracket, and means for driving the pairs of contacts together as the latch is being locked.

17. The bracket of claim 11, in which the driving means comprises a pair of upwardly opening pockets on the aspirator, and a pair of ramps on the bracket that drive first and second pairs of contacts into engagement as the latch is being locked.

18. The bracket of claim 11, wherein the lever includes a squeeze plate adapted for use by the user's index finger.

19. A portable aspirator and bracket assembly, comprising a portable aspirator;

a bracket adapted to hold the portable aspirator, the bracket comprising:

a T-shape member comprising a latch and a lever, the latch being movable between a first position in which the aspirator is held by the bracket and a second position in which the aspirator is not held by the bracket;

a notch on the aspirator adapted to receive the latch for locking the portable aspirator in the bracket; and a handle on the aspirator adapted to be grasped by one of a user's hand;

wherein the lever is adapted to be movable toward the aspirator by the one user's hand while grasping the handle to allow removal of the aspirator from the bracket by the handle;

wherein the bracket includes at least one ramp configured to pull the aspirator toward the bracket, wherein the at least one ramp is wedge-shaped.

20. The bracket of claim 12, wherein the at least one ramp is configured to translate a portion of a vertical force on the aspirator to a horizontal force when the aspirator begins to engage the bracket.

* * * * *